US006388401B1

(12) United States Patent
Van Tiel et al.

(10) Patent No.: US 6,388,401 B1
(45) Date of Patent: May 14, 2002

(54) COLOR DISPLAY DEVICE HAVING QUADRUPOLE CONVERGENCE COILS

(75) Inventors: Antonius Henricus Van Tiel; Albertus Aemilius Seyno Sluijterman, both of Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/653,783

(22) Filed: Sep. 1, 2000

(30) Foreign Application Priority Data

Sep. 6, 1999 (EP) ..... 99202902

(51) Int. Cl.[7] ..... G09G 1/28

(52) U.S. Cl. ..... 315/368.11; 315/368.26; 315/368.28; 348/831; 335/298

(58) Field of Search ..... 315/368.11, 368.25, 315/368.26, 368.27, 368.28; 313/409, 412, 413, 421, 440, 442; 335/210, 212, 298; 348/828–831

(56) References Cited

U.S. PATENT DOCUMENTS 4,138,628 A * 2/1979 Smith ..... 315/368.27
5,070,280 A 12/1991 Okuyama et al. ..... 315/368.11
6,087,768 A * 7/2000 Beirens ..... 313/442
6,111,348 A * 8/2000 Horne et al. ..... 313/402

OTHER PUBLICATIONS

"Color Display Device Having Quadrupole Convergence Coils", U.S. Ser. No. 09/338,048.

"Color Display Device Having Quadrupole Convergence Coils", U.S. Ser. No. 09/338,049.

* cited by examiner

*Primary Examiner*—Haissa Philogene

(57) ABSTRACT

The invention relates to a color display device comprising an in-line electron gun (5) for generating three electron beams (6,7,8), a deflection unit (51) for deflecting the electron beams (6,7,8) and a convergence unit (14') for dynamically influencing the convergence of the electron beams. A variable transformer (40) is connected between the convergence unit (14') and the deflection unit (51) for compensating undesired voltages induced by the deflection unit (51). The variable transformer (40) comprises three coils (47,48,49) wound around a hollow coil holder (43) and an adjustable core (42), which moves within the coil holder.

5 Claims, 2 Drawing Sheets

COLOR DISPLAY DEVICE HAVING QUADRUPOLE CONVERGENCE COILS

BACKGROUND OF THE INVENTION

The invention relates to a color display device comprising an in-line electron gun for generating three electron beams, a phosphor screen on an inner surface of a display window, and a unit for deflecting the electron beams across the color selection electrode.

Such display devices are known.

A current aim is to make the outer surface of the display window flatter, so that the image represented by the color display device is perceived by a viewer as flat. However, an increase of the radius of curvature of the outer surface will lead to an increase of a number of problems. The radius of curvature of the inner surface of the display window and the color selection electrode should increase, and, as the color selection electrode becomes flatter, the strength of the color selection electrode decreases and hence the sensitivity to doming and vibrations increases. An alternative solution to this problem would be to curve the inner surface of the display window more strongly than the outer surface. By virtue thereof, a color selection electrode having a relatively small radius of curvature can be used. As a result, doming and vibration problems are reduced, but other problems occur instead. The thickness of the display window is much smaller in the center than at the edges. As a result, the weight of the display window increases and the intensity of the image decreases substantially towards the edges.

EP 0,421,523 discloses a color cathode ray tube with an in-line gun, a pin cushion correcting yoke and an eyebrow effect electronoptical distortion correction device comprising two pairs of coils, each pair having a coil on each outer electron beam side of the neck in the plane of the beams. The coil pairs are spaced apart along the z-axis between the gun and the yoke and are driven by a sawtooth current having a bow-tie envelope synchronous with the raster scan to correct the dynamic, asymmetrical eyebrow effect which is apparent as a purity defect on the raster.

WO 99/34392 describes a color display device comprising a color cathode ray tube including an in-line electron gun for generating three electron beams located substantially within a plane extending in an X-direction of a rectangular X-Y coordinate system, a color selection electrode, deflection means for deflecting the electron beams located at a deflection plane, and first and second influencing means to dynamically influence the convergence of the electron beams, to decrease a distance between the electron beams at a location of the deflection plane.

In the non-prepublished applications U.S. Ser. No. 09/338048 and U.S. Ser. No. 09/338049 advantageous embodiments of the first and second deflection means are described.

SUMMARY OF THE INVENTION

It is an object of the invention to provide an improved color display device. To this end, the invention provides a color display device as defined in the independent claim. The dependent claims define advantageous embodiments.

These and other objects of the invention are apparent from and will be elucidated with reference to the embodiments described hereinafter.

BRIEF DESCRIPTION OF THE DRAWING

In the drawing.

The Figures are not drawn to scale. In the Figures, like reference numerals generally refer to like parts.

DESCRIPTION OF THE PREFERRED EMBODIMENT

Figure 1:
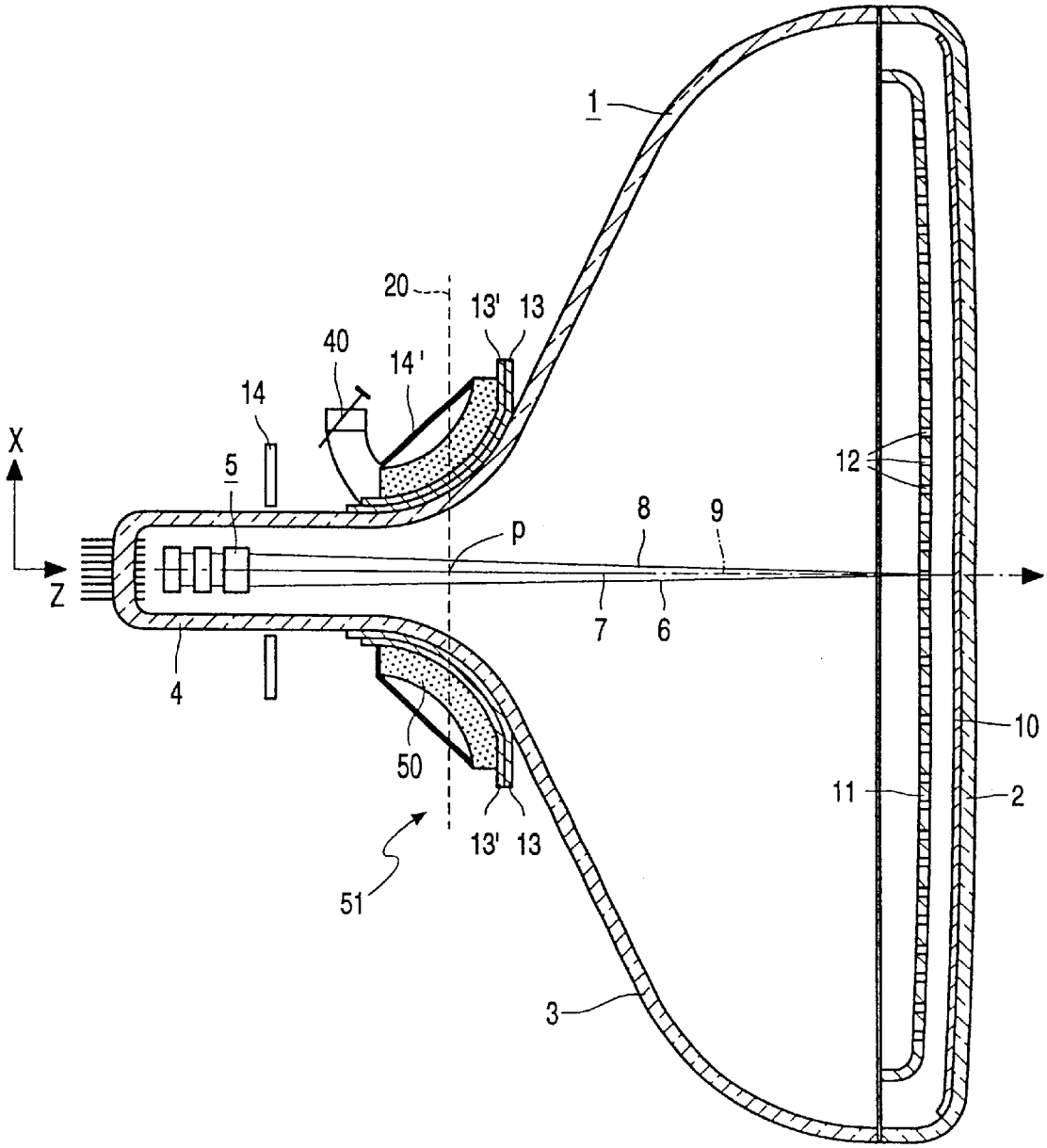
FIG. 1 is a sectional view of a display device, in which the invention is schematically shown.

The display device shown in FIG. 1 comprises a cathode ray tube, in this example a color display tube, having an evacuated envelope 1 which includes a display window 2, a cone portion 3 and a neck 4. The neck 4 accommodates an in-line electron gun 5 for generating three electron beams 6, 7 and 8 which extend in one plane, the in-line plane, which in this case is the plane of the drawing. In the undeflected state, the central electron beam 7 substantially coincides with the tube axis 9.

The inner surface of the display window is provided with a display screen 10. The display screen 10 comprises a large number of phosphor elements luminescing in red, green and blue. On their way to the display screen, the electron beams are deflected across the display screen by way of an electromagnetic deflection unit 51 and pass through a color selection electrode 11 which is arranged in front of the display window 2 and comprises a thin plate having apertures 12. The three electron beams 6, 7 and 8 pass through the apertures 12 of the color selection electrode at a small angle relative to each other and hence each electron beam impinges only on phosphor elements of one color. In addition to a coil holder 13, the deflection unit 51 comprises, deflection coils 13' for deflecting the electron beams in two mutually perpendicular directions, and a yoke ring 50 which surrounds the deflection coils. The display device further includes means for generating voltages which, during operation, are fed to components of the electron gun via feedthroughs. The deflection plane 20 is schematically indicated as well as the distance p between the electron beams 6 and 8 in this plane.

The color display device comprises two electron beam convergence influencing units 14, 14', the first unit 14 being used, in operation, to dynamically bend, i.e. as a function of the deflection in a direction, the outermost electron beams towards each other, and the second unit 14' serving to dynamically bend the outermost electron beams in opposite directions.

The two units 14, 14' are positioned at some distance from each other, and are used to vary the distance p, as a function of the deflection, in such a manner that the distance p decreases as a function of the deflection in at least one direction. The first unit 14 is positioned close to the gun and will be referred to as the "gun quadrupole", whereas the second unit 14' is preferably wound around the yoke ring 50 and will be referred to as the "yoke quadrupole".

Figure 2:
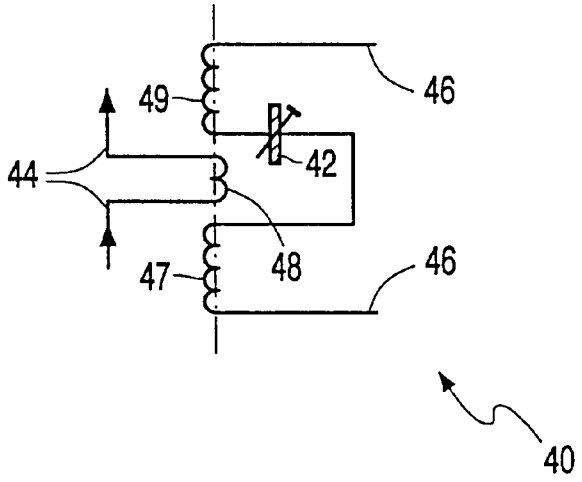
FIG. 2 is a schematic cross-section of a variable transformer according to the invention.
Figure 3:
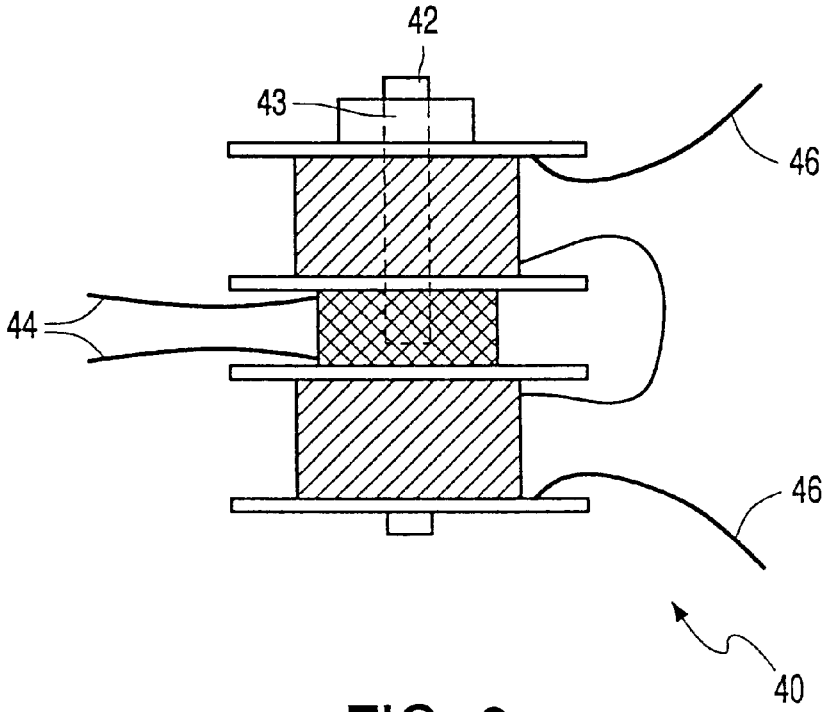
FIG. 3 shows an embodiment of the variable transformer according to the invention.

FIG. 2 is a schematic cross-section of the variable transformer 40 according to the invention and FIG. 3 shows a practical embodiment of this variable transformer.

An improvement of the color display device is obtained if the second convergence unit 14' is electrically connected to the deflection unit 51 via the variable transformer 40. This embodiment solves the problem that may arise if a line coil, which is comprised in the deflection unit 51, induces a voltage across connection wires of the yoke quadrupole. Such a voltage is induced, for example, when the yoke ring 50 is shifted sidewards to eliminate line symmetry convergence errors. This voltage is significant (several volts) and may interfere with driving electronics that have to supply a predefined current to the quadrupole. A way to eliminate this voltage is to position a capacitor over the connection wires of the quadrupole element. However, such a capacitor causes a current in the quadrupole, thus creating line symmetry errors.

A variable transformer 40 is used in the embodiment of FIGS. 2 and 3. A line-frequency voltage having the same value and opposite sign (polarity) as the voltage induced in the quadrupole element is obtained with the variable transformer 40. In this way, the induced voltage is exactly compensated and the electronic driving of the quadrupole functions satisfactorily.

The variable transformer 40 comprises an adjustable core 42, a hollow coil holder 43 and three coils 47,48,49 wound around the coil holder. Wires 44 of the middle coil 48, which is the primary coil, are connected in series with the line coil. The secondary coils 47,49 are connected in series and generate a voltage equal to zero across wires 46 if the core 43 is positioned exactly in the middle of the core holder. The wires 46 are connected to the quadrupole unit 14'. Movement of the core 43 in the holder creates a voltage in one of the two secondary coils 47,49. Polarity and amplitude of this voltage depend upon the direction and the amount of the movement of the core, which is preferably made of ferroxcube.

In summary, a preferred embodiment of the invention relates to a color display device comprising an in-line electron gun 5 for generating three electron beams 6,7,8, a deflection unit 51 for deflecting the electron beams, and a convergence unit 14' for dynamically influencing the convergence of the electron beams. A variable transformer 40 is connected between the convergence unit 14' and the deflection unit 51 for compensating undesired voltages induced by the deflection unit 51. The variable transformer 40 comprises three coils 47,48,49 wound around a hollow coil holder 43 and an adjustable core 42, which moves within the coil holder.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The verb "to comprise" and its conjugations do not exclude the presence of elements or steps other than those stated in a claim. The article "a" or "an" preceding an element does not exclude the presence of a plurality of such elements.

What is claimed is:

1. A color display device comprising:

an in-line electron gun for generating central and first and second outer electron beams, said electron beams being located substantially within a plane extending in an x-direction of a rectangular X-Y coordinate system, deflection means for deflecting the electron beams, first convergence means disposed closer to the electron gun than to the deflection means for dynamically influencing the convergence of the electron beams in a first direction, second convergence means disposed adjacent the deflection means for dynamically influencing the convergence of the electron beams in a second direction, the second convergence means being electrically connected to the deflection means via a variable transformer for compensating a voltage induced in said second convergence means by the deflection means.

2. a color display device is claimed in claim 1, wherein the variable transformer comprises an adjustable core.

3. A color display device is claimed in claim 1, wherein the variable transformer comprises three coils wound around a coil holder.

4. A color display device is claimed in claim 3, wherein the adjustable core comprises ferroxcube and is movable within the coil holder.

5. A color display device as in claim 2 where the second convergence means comprises a quadrupole device for decreasing the distance between the first and second outer electron beams as a function of deflection of said beams from a central axis of the display device.

* * * * *